United States Patent [19]

Burton

[11] 4,065,017

[45] Dec. 27, 1977

[54] SAFETY CONTAINER AND CLOSURE

[75] Inventor: George William Burton, London, England

[73] Assignee: Johnsen & Jorgensen (Plastics) Limited, London, England

[21] Appl. No.: 733,420

[22] Filed: Oct. 18, 1976

[30] Foreign Application Priority Data

Oct. 22, 1975 United Kingdom ..... 43418/75

[51] Int. Cl.[2] ..... B65D 55/02; B65D 85/56; A61J 1/00

[52] U.S. Cl. ..... 215/211; 215/206

[58] Field of Search ..... 215/206, 211, 213, 214, 215/224, 225, 355, 356

[56] References Cited

U.S. PATENT DOCUMENTS

| | | | |
|---|---|---|---|
| 3,845,874 | 11/1974 | Robbins et al. | 215/214 |
| 3,980,194 | 9/1976 | Costa | 215/206 |

*Primary Examiner*—George T. Hall

*Attorney, Agent, or Firm*—Schuyler, Birch, Swindler, McKie & Beckett

[57] ABSTRACT

This invention provides a container and closure assembly. The closure consists of a plug which fits into the mouth of the container in such a position that removal of the closure is prevented until the closure is turned to bring a recessed thumb grip on the side of the closure into registration with a gap in the container wall. When the closure is in this position the closure can be pushed out of the container by passing the thumb of the user through the gap.

8 Claims, 10 Drawing Figures

SAFETY CONTAINER AND CLOSURE

This invention is concerned with the provision of a child-resistant closure and container assembly, that is to say to provide such an assembly in which it is difficult for a child to remove the closure.

According to the present invention, there is provided a container and closure assembly wherein the closure is in the form of a bung or plug which when in use fits within the mouth of the container in a position in which removal of the closure is prevented unless the closure is angularly adjusted into a predetermined position relative to a peripheral gap in the side wall the container adjacent to the mouth. In one embodiment the closure has a recessed thumb grip on its periphery so that when the thumb grip on the closure is in registration with the gap in the container wall the plug can be pushed out of the container by passing the thumb of a user through the gap but when the thumb grip is out of registration with the gap removal of the closure is very difficult because there is nothing to get hold of or provide a friction grip.

In order that the invention may be more clearly understood reference is now directed to the accompanying drawings given by way of example which:

Figure 1:
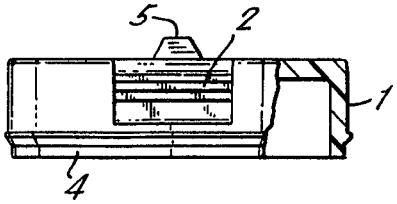
FIG. 1 is a side elevation, partly in section, of a closure forming part of an assembly in accordance with the invention.
Figure 2:
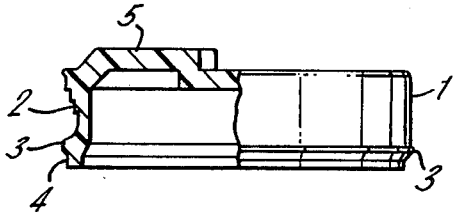
FIG. 2 is a view similar to FIG. 1 with the closure turned through 90°.
Figure 3:
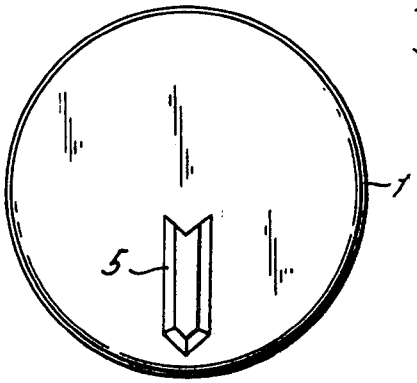
FIGS. 3 and 4 are respectively a top plan and a bottom plan.
Figure 5:
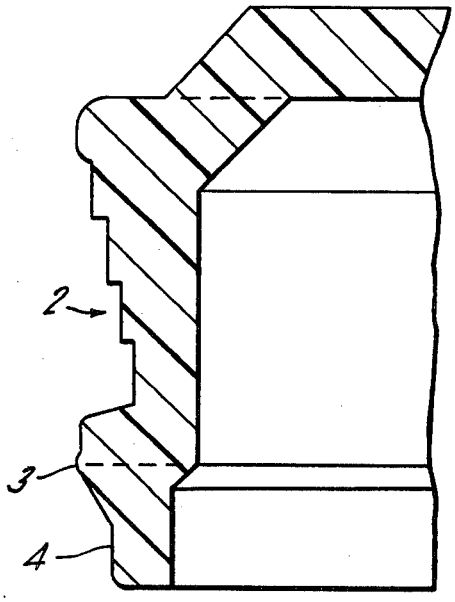
FIG. 5 is an enlongated detail view of a thumb grip shown in section.
Figure 4:
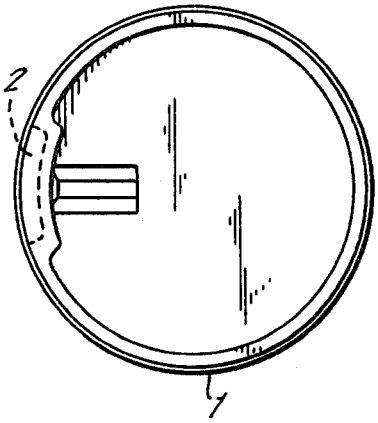
Figure 6:
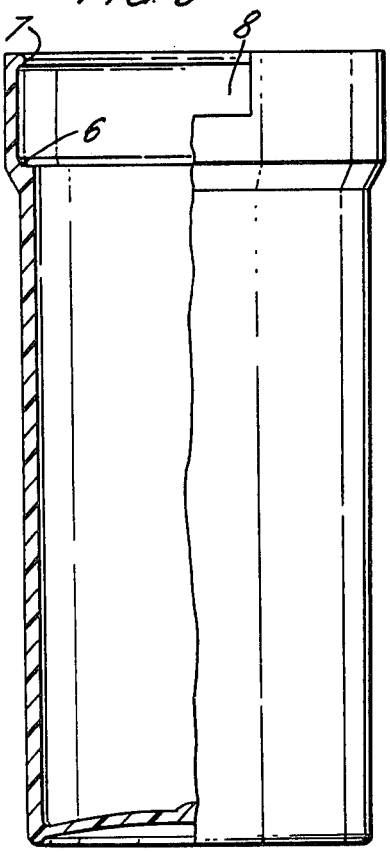
FIG. 6 is a side elevation, partly in section, of a tubular container forming part of an assembly in accordance with the invention.
Figure 8:
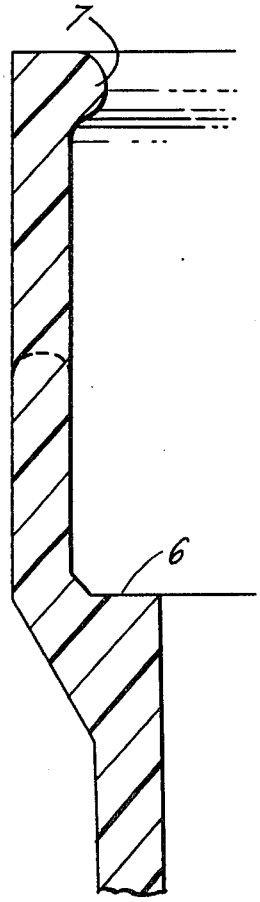
FIG. 8 is a detail sectional view to an enlarged scale showing the inside profile of the container adjacent to the mouth.
Figure 7:
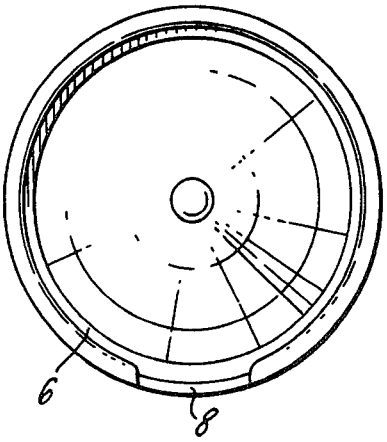
FIG. 7 is a detail plan view showing the gap.
Figure 9:
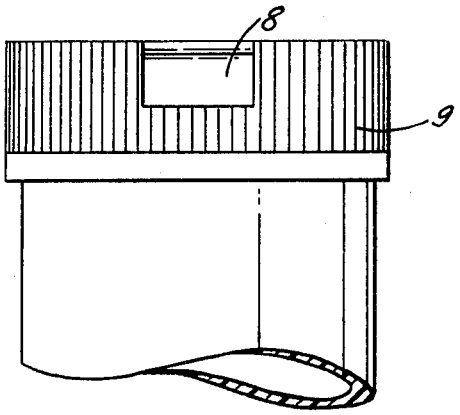
FIG. 9 is a side view of a container with a top serrated to simulate a closure.
Figure 10:
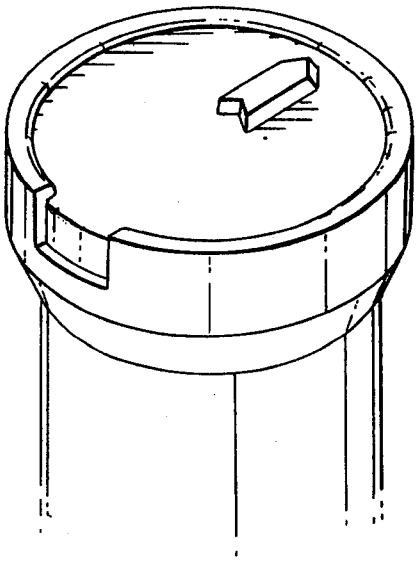
FIG. 10 is a perspective view of an assembly with the closure in position.

Referring to FIGS. 1 and 5 the upper part of a closure has a smooth skirt or side wall 1 with the exception of a recessed thumb grip 2. The skirt 1 terminates at the lower end in a continuous annular sealing bead 3 and a lead in part 4. An embossed arrow 5 is provided on the top of the closure which, as illustrated, is in the form of a bung adapted to seat within the mouth of a tubular container with the top of the closure below the edge of the mouth of the container.

FIGS. 6 to 9 illustrate a container with an internal annular step 6, an annular retaining bead 7 around the mouth and a gap or cut-out 8 in the side wall.

In operation the closure is snapped into the mouth of the container in a conventional manner as for other plug-type closures so that the closure sits on the step 6 in the container and is retained in position by the bead 7. It will be understood that the depth of the skirt of the closure from top to bottom is dimensioned so as to be substantially the same as the depth of the container from just below the bead 7 to the step 6.

When in the closed position there is nothing for a child to get hold of which would enable him to pull or prize the closure from the container, as the arrow, which is the only protrusion, is too shallow for that purpose. Also, the chances are that the part of the closure that is visible through the gap 8 in the container will be smooth and so would offer no grip which would allow the closure to be removed.

To remove the closure from the container it is necessary to angularly adjust the closure relatively to the container using the projecting arrow as a key until the arrow points directly at the centre of the gap 8 in the container wall in which position the thumb grip 2 on the closure comes into registration with the gap 8. In other words, the thumb grip is directly below the arrow. The closure can now be removed from the container by passing the thumb through the gap 8 in the container wall and then by pressing or pushing against the thumb grip in an upward direction until the closure is released. As a refinement the top of the container may be knurled as at 9 in FIG. 9 to simulate a cap so that a child trying to get at the contents of the container may try to turn the top of the container.

We have therefore, provided a container and closure assembly wherein the sidewall of the container has a peripheral gap adjacent to the mouth of the container and wherein the closure is in the form of a bung adapted to seat within the mouth of the container with the top of the bung below the level of the edge of the mouth of the container and having a thumb grip in the periphery of the bung, removal of the closure being very difficult unless the closure be manipulated to bring the thumb grip into registration with the gap in the container wall.

If desired, more than one thumb grip 2 may be provided though it is preferred to provide only one for optimum child resistance.

The invention includes not only the assembly of the two parts but also a closure for use in an assembly and a container for use in an assembly.

The assembly may be made of any suitable material, e.g. plastics material.

I claim:

1. A container and closure assembly comprising a container having a circular mouth, plug means matingly received securely within said mouth, said plug means having a top and a generally cylindrical side wall, said top being configured to prevent a user from gripping and pulling said plug means from said mouth, said container having a side wall with an opening therethrough adjacent said mouth sized to enable a user's finger to solidly contact the plug side wall through said opening, a minor segment of the circumference of said plug side wall having an irregular surface providing sufficient friction to enable a user to manually push said plug means out of said mouth, the major portion of the circumference of said plug side wall having a smooth surface providing insufficient friction to enable a user to manually push said plug means out of said mouth, and said plug means being manually rotatable within said mouth to selectively expose the irregular surface or a portion of the smooth surface of the plug side wall through the opening through the container side wall.

2. A container and closure assembly as recited in claim 1 further comprising means on said top for indicating the location of the irregular surface of the plug side wall.

3. A container and closure assembly as recited in claim 1 wherein one end of said container is knurled to simulate a cap.

4. An assembly according to claim 1 wherein the plug means seats within the mouth of the container with the top of the plug means below the level of the edge of the mouth of the container.

5. An assembly according to claim 1 wherein the plug means has a peripheral thumb grip recessed into the sidewall of the plug means to facilitate removal of the closure.

6. An assembly according to claim 1 wherein the plug means is in the form of a hollow bung with a depending skirt terminating at the lower end of a continuous annular sealing bead with a lead-in part below the bead.

7. An assembly according to claim 2 wherein an embossed arrow is provided on the top of the closure immediately above a peripheral thumb grip in the side wall of the closure.

8. An assembly according to claim 1 wherein the container has an internal annular step on which the closure seats and an annular inner retaining bead around the inside of the mouth below which the closure seats.

* * * * *